US007307052B2

(12) United States Patent
Murthy et al.

(10) Patent No.: US 7,307,052 B2
(45) Date of Patent: Dec. 11, 2007

(54) CLEANING COMPOSITION WITH IMPROVED DISPENSING AND CLING

(75) Inventors: Geetha Murthy, Oakland, CA (US); Daniela Fritter, Oakland, CA (US); Robert J. Iliff, Pleasanton, CA (US); Paula Ann Sanchez, Pleasant Hill, CA (US)

(73) Assignee: The Clorox Company, Oakland, CA (US)

( * ) Notice: Subject to any disclaimer, the term of this patent is extended or adjusted under 35 U.S.C. 154(b) by 171 days.

(21) Appl. No.: 11/259,963

(22) Filed: Oct. 26, 2005

(65) Prior Publication Data

US 2007/0093401 A1 Apr. 26, 2007

(51) Int. Cl.

| | |
|---|---|
| ***C11D 1/90*** | (2006.01) |
| ***C11D 3/14*** | (2006.01) |
| ***C11D 3/39*** | (2006.01) |
| ***C11D 3/395*** | (2006.01) |
| ***C11D 9/20*** | (2006.01) |

(52) U.S. Cl. ..... 510/191; 510/238; 510/372; 510/375; 510/379; 510/380; 510/433; 510/481; 510/503

(58) Field of Classification Search ..... 510/191, 510/238, 372, 375, 379, 380, 433, 481, 503
See application file for complete search history.

(56) References Cited

U.S. PATENT DOCUMENTS

| | | | | |
|---|---|---|---|---|
| 3,852,210 | A | 12/1974 | Krezanoski | 252/95 |
| 4,122,043 | A | 10/1978 | Kersnar et al. | 252/527 |
| 4,271,030 | A | 6/1981 | Brierly et al. | 252/98 |
| 4,337,163 | A | 6/1982 | Schilp | 252/96 |
| 4,375,421 | A | 3/1983 | Rubin et al. | 252/110 |
| 4,388,204 | A | 6/1983 | Dimond et al. | 252/98 |
| 4,396,525 | A | 8/1983 | Rubin et al. | 252/174.25 |
| 4,474,677 | A | 10/1984 | Foxlee | 252/98 |
| 4,478,734 | A | 10/1984 | Ogino et al. | 252/117 |
| 4,576,728 | A | 3/1986 | Stoddart | 252/102 |
| 4,595,526 | A | 6/1986 | Lai | 252/545 |
| 4,699,728 | A | 10/1987 | Riehm et al. | 252/142 |
| 4,743,395 | A | 5/1988 | Leifheit | 252/106 |
| 4,770,814 | A | 9/1988 | Rose et al. | 252/315.4 |
| 4,772,424 | A | 9/1988 | Greeb | 252/546 |
| 4,772,425 | A | 9/1988 | Chirash et al. | 252/547 |
| 4,783,283 | A * | 11/1988 | Stoddart | 510/373 |
| 4,800,036 | A | 1/1989 | Rose et al. | 252/102 |
| 4,900,467 | A | 2/1990 | Smith | 252/95 |
| 5,011,538 | A | 4/1991 | Smith | 134/22.13 |
| 5,055,219 | A | 10/1991 | Smith | 252/102 |
| 5,261,567 | A | 11/1993 | Krall | 222/153 |
| 5,336,426 | A | 8/1994 | Rader et al. | 252/102 |
| 5,389,157 | A | 2/1995 | Smith | 134/22.13 |
| 5,688,435 | A * | 11/1997 | Chang et al. | 252/187.25 |
| 5,833,764 | A | 11/1998 | Rader et al. | 134/22.11 |
| 6,221,827 | B1 | 4/2001 | Mendoza et al. | 510/380 |
| 6,234,412 | B1 | 5/2001 | Von Schuckmann | 239/333 |
| 6,425,406 | B1 | 7/2002 | Klinkhammer et al. | 134/22.19 |
| 6,479,444 | B1 | 11/2002 | Porticos et al. | 510/195 |
| 6,583,103 | B1 | 6/2003 | Klinkhammer | 510/478 |
| 6,638,900 | B2 | 10/2003 | Ajmani et al. | 510/372 |
| 6,660,702 | B2 | 12/2003 | Ajmani et al. | 510/195 |
| 6,691,328 | B2 | 2/2004 | Delfino | 4/227.1 |
| 6,900,164 | B2 | 5/2005 | Ajmani et al. | 510/195 |
| 2005/0079990 | A1 | 4/2005 | Chan et al. | 510/438 |
| 2006/0247151 | A1 * | 11/2006 | Kaaret et al. | 510/503 |

* cited by examiner

*Primary Examiner*—Brian Mruk
(74) *Attorney, Agent, or Firm*—Alok Goel; David Peterson

(57) ABSTRACT

A thickened oxidant composition is formulated to be easily and evenly applied to a vertical surface to provide consumer preferred cling to the vertical surface. The composition has a low relaxation constant. The composition is useful in cleaning toilet bowls and other hard surfaces. The composition can be applied in a stream, a spray, or an aerosol.

21 Claims, No Drawings

CLEANING COMPOSITION WITH IMPROVED DISPENSING AND CLING

BACKGROUND OF THE INVENTION

1. Field of the Invention

The present invention relates to thickened oxidant compositions, having both viscous and elastic properties, and in particular to thickened bleach compositions which are formulated to pour easily and flow through a narrow orifice or trigger spray bottle. The compositions also provide improved cling to vertical surfaces, such as toilet bowls.

2. Description of the Related Art

Hard surface cleaners are often thickened to provide to the consumer some control over the product during application, and to cling to the surface for some time after application in order to increase the contact time of the cleaning components. Furthermore, such thickened products are often put into packages with a closure that constricts the product to squeeze out in a narrow stream, for even more powerful and controllable product flow during application.

Consumer preferred products of this type therefore must have optimum flow properties under both dispensing and surface coating conditions. Products require ease of squeezing and projecting a fluid stream onto a surface. Products additionally require effectiveness of product coating and clinging to a surface. This optimization requires a balance. With too little thickening, the product will drain too quickly and result in insufficient perceived cling. With too much thickening, the product could result in dispensing problems or non-uniform coating.

A typical approach by those skilled in the art targets a higher product viscosity at low shear rates to ensure adequate cling, combined with a lower product viscosity at high shear rates to ensure ease of dispensing. A formulator might thus look for chemistries that result in sufficiently shear-thinning products to hit such viscosity ranges at both low and high shear rates.

Such systems are generally not difficult to formulate, and examples can be found on the market. However, the products that exhibit the most consumer preferred rheology for dispensing and coating are the non-bleach systems, for which thickening formulation approaches are much broader than for bleach-containing systems. Manufacturers have not been able to achieve the same optimum aesthetics with bleach-containing systems, which are commonly thickened with bleach stable surfactants, even though these formulations might be within the target viscosity ranges at low and high shear rates.

Formulators attempting to make improvements to product cling are most likely to make changes that increase the viscosity at low shear rate. This often has the effect of also increasing elasticity, and can actually negate any gains made to perceived cling by the increased viscosity. Alternatively, formulators may incorporate a component that forms weak interactions with the thickening system, which adds to the viscosity at low shear rates while having minimal impact at high shear rates. Aside from the added cost and formulation complexity, such additives may have a negative impact on the product aesthetics, e.g. forming an insoluble layer on the water surface in a toilet bowl or sticking to the hard surface to the point where it is difficult to rinse it away. Building the specified rheology with such a "filled" viscoelastic system is therefore not desirable.

Advantageously, the compositions of the invention are also suitable for the bleaching of different types of surfaces including hard-surfaces like floors, walls, tiles, glass, kitchen surfaces, bathrooms surfaces, toilet bowls and/or dishes and the like as well as fabrics. It is therefore an object of the present invention to provide a bleach-containing cleaning composition for use on a cleaning substrate that overcomes the disadvantages and shortcomings associated with prior art cleaning compositions for cleaning hard surfaces.

SUMMARY OF THE INVENTION

In accordance with the above objects and those that will be mentioned and will become apparent below, one aspect of the present invention comprises a cleaning system comprising:

a. a composition comprising:
   i. greater than 0.5% oxidant, and
   ii. a surfactant,
   iii. wherein the composition has a Zero-shear viscosity greater than 100 cP;
   iv. wherein the composition has a Relaxation constant of less than 0.1 second.
b. a container having the composition within; and
c. instructions to apply the composition to the side of a toilet bowl.

In accordance with the above objects and those that will be mentioned and will become apparent below, another aspect of the present invention comprises a cleaning system comprising:

a. a composition comprising:
   i. greater than 0.5% oxidant, and
   ii. a surfactant;
   iii. wherein the composition has a Zero-shear viscosity greater than 100 cP; and
   iv. wherein the composition has a Relaxation constant of less than 0.1 second;
b. a container having the composition within; and
c. instructions to spray the composition on a vertical hard surface.

In accordance with the above objects and those that will be mentioned and will become apparent below, another aspect of the present invention comprises a cleaning composition comprising:

a. an oxidant;
b. wherein the composition has a Zero-shear viscosity greater than 100 cP; and
c. wherein the composition has a Relaxation constant of less than 0.1 second.

Further features and advantages of the present invention will become apparent to those of ordinary skill in the art in view of the detailed description of preferred embodiments below, when considered together with the attached claims.

DETAILED DESCRIPTION OF THE INVENTION

Before describing the present invention in detail, it is to be understood that this invention is not limited to particularly exemplified systems or process parameters that may, of course, vary. It is also to be understood that the terminology used herein is for the purpose of describing particular embodiments of the invention only, and is not intended to limit the scope of the invention in any manner.

All publications, patents and patent applications cited herein, whether supra or infra, are hereby incorporated by reference in their entirety to the same extent as if each individual publication, patent or patent application was specifically and individually indicated to be incorporated by reference.

It must be noted that, as used in this specification and the appended claims, the singular forms "a," "an" and "the" include plural referents unless the content clearly dictates otherwise. Thus, for example, reference to a "surfactant" includes two or more such surfactants.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

The cleaning composition can be used as a disinfectant, sanitizer, and/or sterilizer. As used herein, the term "disinfect" shall mean the elimination of many or all pathogenic microorganisms on surfaces with the exception of bacterial endospores. As used herein, the term "sanitize" shall mean the reduction of contaminants in the inanimate environment to levels considered safe according to public health ordinance, or that reduces the bacterial population by significant numbers where public health requirements have not been established. An at least 99% reduction in bacterial population within a 24 hour time period is deemed "significant." As used herein, the term "sterilize" shall mean the complete elimination or destruction of all forms of microbial life and which is authorized under the applicable regulatory laws to make legal claims as a "Sterilant" or to have sterilizing properties or qualities.

In the application, effective amounts are generally those amounts listed as the ranges or levels of ingredients in the descriptions, which follow hereto. Unless otherwise stated, amounts listed in percentage ("%'s"): are in weight percent (based on 100% active) of the cleaning composition alone.

As used herein, the term "polymer" generally includes, but is not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configurations of the molecule. These configurations include, but are not limited to isotactic, syndiotactic and random symmetries.

The term "cleaning composition", as used herein, is meant to mean and include a cleaning formulation having at least one surfactant.

The term "surfactant", as used herein, is meant to mean and include a substance or compound that reduces surface tension when dissolved in water or water solutions, or that reduces interfacial tension between two liquids, or between a liquid and a solid. The term "surfactant" thus includes anionic, nonionic and/or amphoteric agents.

It should be noted that as used herein the term "cleaning" refers generally to a chemical, physical or enzymatic treatment resulting in the reduction or removal of unwanted material, and "cleaning composition" specifically includes toilet bowl cleaners, drain openers, hard and soft surface cleaners and bleaching compositions. The cleaning composition may consist of a variety of chemically, physically or enzymatically reactive active ingredients, including solvents, acids, bases, oxidants, reducing agents, enzymes, detergents and thioorganic compounds.

The compositions of the invention may be in liquid aqueous form. They may comprise water in an amount of from 60% to 98% by weight, or from 80% to 97%, or from 85% to 97% by weight of the total aqueous liquid oxidant composition.

Rheology

The current invention resolves the problem of achieving consumer preferred dispensing and cling by identifying an additional rheological property that significantly influences the consumer's perception of cling. Specifically, there are two components to good product cling: (1) an adequate value of viscosity at low shear rate, as already mentioned, and (2) a sufficiently high "liquification rate " of the product as it is applied to the surface. For embodiments of the invention that have a viscoelastic character, the liquification rate is inversely related to the material's relaxation time. Bleach-containing systems typically have an inadequate and lower liquification rate when formulated to satisfy condition (1), and thus will exhibit more elastic properties in the short time interval in which the product hits the surface and begins flowing to form a coating. These elastic properties can result in unevenness of the coating and a sense of inadequate product cling, even though the coating might be quite thick and slow draining in some places.

The current invention makes use of the surprising discovery that product cling can be enhanced without increasing the low shear viscosity, and can in fact accompany a decrease in low shear viscosity. This is accomplished by minimizing the elastic manifestations on product application, which leads to better coating efficiency and perceived cling.

The inventive cleaners can be Theologically characterized as viscoelastic, with fluid-like behavior at slow deformation rates, elastic behavior at high deformation rates, and an associated Relaxation constant that characterizes the boundary between the predominantly fluid and predominantly elastic regions. For embodiments of the invention that have a viscoelastic character, optimized cling can be achieved by formulating the material with a low Relaxation constant, for example less than 0.1 s and with a Zero-shear viscosity greater than 100 cP, or greater than 200 cP. Systems that meet these requirements will generally also be easy to dispense. Those skilled in the art can formulate such systems using the appropriate blend of bleach-stable surfactants, while accounting for the effects of other ingredients such as fragrance.

The compositions disclosed herein have elasticities and viscosities that are crucial rheological characterization parameters. Instruments capable of performing oscillatory or controlled stress creep measurements can be used to quantify elasticity. The rheology of the compositions disclosed herein was measured with a Stresstech rheometer at 25 ° C. in the oscillatory mode and in the viscometry mode, using concentric cylinder geometry. A frequency sweep with a Stresstech rheometer produces oscillation data which shows the elastic and viscous moduli, G' and G", respectively, and the complex viscosity, as a function of frequency. For the viscoelastic compositions disclosed herein, G" dominates G' at low frequency, where the system is characterized by the Zero-shear viscosity, the plateau value of the complex viscosity with decreasing frequency. The elasticity increases in relative importance with increasing frequency, which can be seen by the faster growth of G' vs. G" and finally a "cross-over" to a region where G' dominates G" at higher frequency. The onset of elasticity in these systems is quantified as the frequency at which G' crosses G", or more conveniently, as the inverse of this quantity, called the Relaxation constant, which has units of time.

Embodiments disclosed herein have Zero-shear viscosities greater than 100 centipoise (cP) and Relaxation constants less than 0.1 seconds (s). Embodiments may also have Gel parameters less than 1.25. Liquids within the specified range of Zero-shear viscosity and having a Relaxation constant of less than 0.1 s will relax against the surface more quickly after being squirted, contributing to a more fluid perception and quicker, more efficient coating, thereby enhancing perceived cling. Liquids with a Zero-shear viscosity less than 100 cP will drain too quickly.

For most viscoelastic systems, the steady-state shear viscosity approaches a plateau as the shear rate is decreased, with a value that is reasonably close to the Zero-shear viscosity from the frequency sweep (Cox-Merz rule). Some products don't have a viscosity plateau with decreasing shear rate. In the "filled" systems, for example, the viscosity continues to climb with decreasing shear rate. In practice, this leads to somewhat gel-like behavior at low shear rate, rather than fluid-like as it would be if the viscosity were constant in this range. One consequence of this gel-like nature at low shear rate is that the product coating is harder to rinse off, for example, by flushing the toilet. Although the process of rinsing may be considered to be in a higher shear rate region where the existence of a low shear plateau seems irrelevant, it should be kept in mind that briefly flushing a coating that has been at rest is more a transient than steady-state process, and will thus reflect a considerable contribution from the low shear behavior. For this reason, materials with a viscosity that increases with decreasing shear rate beyond the break point (i.e., the point at which the curve can be expected to start flattening out with decreasing shear rate) are generally not desirable. A parameter that can be used to identify such systems is the ratio of shear viscosity at some defined rate below the break point to the Zero-shear viscosity from the frequency sweep. The Gel parameter is the ratio of steady-state shear viscosity at a shear rate of $2\pi/(100*RC)$ to Zero-shear viscosity (from frequency sweep). Liquids with gel parameters greater than 1.25 are generally harder to rinse.

Surfactants and Counterions

Where present the surfactant may be selected from anionic, nonionic, cationic, zwitterionic, amphoteric and mixtures thereof. In one embodiment of the present invention the surfactant is selected from amphoteric, zwitterionic and mixtures thereof. In another embodiment of the present invention, the surfactant is selected from amine oxide, betaine, sulphobetaine and mixtures thereof. In another embodiment of the present invention, the surfactant is selected from amine oxide, soap and mixtures thereof.

A suitable anionic surfactant is an alkali metal soap (alkyl carboxylates). The soaps utilized are typically formed in situ, by using the appropriate carboxylic acid (e.g., a $C_{6-18}$ carboxylic acid, such as, without limitation, lauric, stearic, myristic acids, and unsaturated acids, such as coco fatty acid), and neutralizing with e.g., sodium hydroxide (NaOH). Other alkali metal hydroxides, such as potassium and lithium hydroxides, can be utilized. Commercial sources of these fatty acids include Henkel Corporation's Emery Division. The soap is present in an amount of about 0.1 to 10%. In one embodiment, the soap is present in an amount of about 0.5-1.5% by weight.

Suitable anionic surfactants for use herein include alkyl sulphates. Suitable alkyl sulphates for use herein include water-soluble salts or acids of the formula $ROSO_3M$ wherein R is a C6-C24 linear or branched, saturated or unsaturated alkyl group, preferably a C8-C20 alkyl group, more preferably a C8-C16 alkyl group and most preferably a C10-C14 alkyl group, and M is H or a cation or ammonium or substituted ammonium. As discussed above, where the surfactant is used as a means of thickening the composition, suitable alkyl sulphates include those having an alkyl chain length of greater than 10 carbon atoms, or from 12 to 20 carbon atoms, or from 12 to 18 carbon atoms. Examples of suitable sulphate surfactants include sodium dodecyl sulphate, sodium tetradecyl sulphate, sodium hexadecyl sulphate. Suitable anionic surfactants for use herein further include alkoxylated sulphate surfactants. Suitable alkoxylated sulphate surfactants for use herein are according to the formula $RO(A)MSO_3M$ wherein R is an unsubstituted C6-C24 alkyl, hydroxyalkyl or alkyl aryl group, having a linear or branched C6- C24 alkyl component, or a C12-C20 alkyl or hydroxyalkyl, or C 12 C18 alkyl or hydroxyalkyl, A is an ethoxy or propoxy or butoxy unit or a mixture thereof, m is greater than zero, typically between 0.5 and 6, or between 0.5 and 3, and M is H or a cation which can be, for example, a metal cation (e.g., sodium, potassium, lithium, calcium, magnesium, etc.), ammonium or substituted-ammonium cation. Alkyl ethoxylated sulphates, alkyl butoxylated sulphates as well as alkyl propoxylated sulphates are contemplated herein.

Where the surfactant is used as a means of thickening the composition, suitable alkoxylated sulphates include those having an alkyl chain length of greater than 12 carbon atoms, or from 14 to 20 carbon atoms, or from 14 to 16 carbon atoms and from 1 to 20 moles of alkoxy groups, or from 1 to 5 alkoxy groups, for example ethoxy groups. Suitable ethoxy sulphate surfactants include sodium dodecyl ethoxy sulphate (ethoxylation degree around 3), sodium tetradecyl ethoxy sulphate (ethoxylation degree around 3), sodium hexadecyl ethoxy sulphate (ethoxylation degree around 4).

Suitable anionic surfactants for use herein further include alkyl aryl sulphates. Suitable alkyl aryl sulphates for use herein include water-soluble salts or acids of the formula $ROSO_3M$ wherein R is an aryl, for example a benzyl, substituted by a C6-C24 linear or branched saturated or unsaturated alkyl group, or a C8-C20 alkyl group, or a C10-C16 alkyl group and M is H or a cation, or ammonium or substituted ammonium.

Suitable anionic surfactants for use herein further include alkyl sulphonates. Suitable alkyl sulphonates for use herein include water-soluble salts or acids of the formula $RSO_3M$ wherein R is a C6-C20 linear or branched, saturated or unsaturated alkyl group, or a C8-C18 alkyl group, or a C14-C17 alkyl group, and M is H or a cation, e.g., an alkali metal cation or ammonium or substituted ammonium.

Suitable anionic surfactants for use herein further include alkyl aryl sulphonates. Suitable alkyl aryl sulphonates for use herein include water-soluble salts or acids of the formula $RSO_3M$ wherein R is an aryl, preferably a benzyl, substituted by a C6-C20 linear or branched saturated or unsaturated alkyl group, for example a C8-C18 alkyl group, or a C9-C14 alkyl group, and M is H or a cation, or ammonium or substituted ammonium.

Suitable anionic surfactants for use herein further include alkoxylated sulphonate surfactants. Suitable alkoxylated sulphonate surfactants for use herein are according to the formula $R(A)mSO_3M$ wherein R is an unsubstituted C6-C20 alkyl, hydroxyalkyl or alkyl aryl group, having a linear or branched C6C20 alkyl component, or a C 12-C20 alkyl or hydroxyalkyl, or a C12-C 18 alkyl or hydroxyalkyl, A is an ethoxy or propoxy or butoxy unit, m is greater than zero, typically between 0.5 and 6, or between 0.5 and 3, and M is H or a cation, ammonium or substitutedammonium cation. Alkyl ethoxylated sulphonates, alkyl butoxylated sulphonates as well as alkyl propoxylated sulphonates are contemplated herein. Suitable anionic surfactants for use herein further include C6-C20 alkyl alkoxylated linear or branched diphenyl oxide disulphonate surfactants. Other suitable anionic surfactants for use herein include alkylcarboxylates.

Other anionic surfactants can include salts (including, for example, sodium, potassium, ammonium, and substituted ammonium salts such as mono-, di- and triethanolamine salts) of soap, C8-C24 olefinsulfonates, sulfonated polycarboxylic acids, acyl glycerol sulfonates, fatty oleyl glycerol sulfates, alkyl phenol ethylene oxide ether sulfates, alkyl phosphates, isethionates such as the acyl isethionates, N-acyl taurates, alkyl succinamates and sulfosuccinates, monoesters of sulfosuccinate (especially saturated and unsaturated C12- C 18 monoesters) diesters of sulfosuccinate (especially saturated and unsaturated C6-C14 diesters), acyl sarcosinates, sulfates of alkyl polysaccharides such as the sulfates of alkylpolyglucoside (the nonionic nonsulfated compounds being described below), branched primary alkyl sulfates, alkyl polyethoxy carboxylates such as those of the formula $RO(CH_2CH_20)_kCH_2COO^-M^+$wherein R is a C8-C 22 alkyl, k is an integer from 0 to 10, and M is a soluble salt-forming cation.

Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. 1 and 11 by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23.

Suitable nonionic surfactants for use herein are fatty alcohol ethoxylates and/or propoxylates, which are commercially available with a variety of fatty alcohol chain lengths and a variety of ethoxylation degrees. Indeed, the HLB values of such alkoxylated nonionic surfactants depend essentially on the chain length of the fatty alcohol, the nature of the alkoxylation and the degree of alkoxylation.

Surfactant catalogues are available which list a number of surfactants, including nonionics, together with their respective HLB values. The preferred nonionic surfactants are capped i.e. those where, instead of an H at the end of the chain there is an R group, preferably a methyl group. Such surfactants are for example marketed by BASF in the Plurafac range, for example Plurafac LF23 1.

Suitable amphoteric surfactants for use herein include amine oxides having the following formula $R^1R^2R^3NO$ wherein each of $R^1$, $R^2$ and $R^3$ is independently a saturated substituted or unsubstituted, linear or branched hydrocarbon chains of from 1 to 30 carbon atoms. Suitable amine oxide surfactants to be used according to the present invention are amine oxides having the following formula $R^1R^2R^3NO$ wherein $R^1$ is an hydrocarbon chain comprising from 1 to 30 carbon atoms, or from 6 to 20, or from 12 to 18, or from 14 to 16, and wherein $R^2$ and $R^3$ are independently substituted or unsubstituted, linear or branched hydrocarbon chains comprising from 1 to 4 carbon atoms, or from 1 to 3 carbon atoms, or are methyl groups. $R^1$ may be a saturated substituted or unsubstituted linear or branched hydrocarbon chain. $R^1$ is suitably a C16 alkyl group. Such amine oxides are commercially available from Hoechst and Clariant.

Suitable zwitterionic surfactants for use herein contain both cationic and anionic hydrophilic groups on the same molecule at a relatively wide range of pH's. The typical cationic group is a quaternary ammonium group, although other positively charged groups like phosphonium, imidazolium and sulfonium groups can be used. The typical anionic hydrophilic groups are carboxylates and sulfonates, although other groups like sulfates, phosphonates, and the like can be used. A generic formula for some zwitterionic surfactants to be used herein is $R^1$ —$N(R^2)(R^3)R^4X^-$ wherein $R^1$ is a hydrophobic group; $R^2$ and $R^3$ are each C1-C4 alkyl, hydroxy alkyl or other substituted alkyl group which can also be joined to form ring structures with the N; $R^4$ is a moiety joining the cationic nitrogen atom to the hydrophilic group and is typically an alkylene, hydroxy alkylene, or polyalkoxy group containing from 1 to 10 carbon atoms; and X is the hydrophilic group which is suitably a carboxylate or sulfonate group. Suitable hydrophobic groups $R^1$ are alkyl groups containing from 1 to 24, or from 12 to 18, or from 14 to 16 carbon atoms. The hydrophobic group can contain unsaturation and/or substituents and/or linking groups such as aryl groups, amido groups, ester groups and the like. In general, the simple alkyl groups are suitable for cost and stability reasons.

Suitable zwitterionic surfactants include betaine and sulphobetaine surfactants, functionalized betaines such as acyl betaines, alkylamidoalkyldimethyl betaines, alkyl imidazoline alanine betaines, glycine betaines, derivatives thereof and mixtures thereof. Suitable betaine and sulphobetaine surfactants for use herein are the betaine/sulphobetaine and betaine-like detergents wherein the molecule contains both basic and acidic groups which form an inner salt giving the molecule both cationic and anionic hydrophilic groups over a broad range of pH values. Some common examples of these detergents are described in U. S. Pat. Nos. 2,082,275, 2,702,279, 2,255,082, and 5,252,245 incorporated herein by reference. Suitable betaine and sulphobetaine surfactants herein are according to the formula $R^2R^1$—$N^+$—$(CH_2)_n$—Y—$R^3$ wherein $R^1$ is a hydrocarbon chain containing from 1 to 24 carbon atoms, or from 12 to 18, or from 14 to 16, wherein $R^2$ and $R^3$ are hydrocarbon chains containing from 1 to 3 carbon atoms, or 1 carbon atom, wherein n is an integer from 1 to 10, or from 1 to 6, or is 1, Y is selected from the group consisting of carboxyl and sulfonyl radicals and wherein the sum of $R^1$, $R^2$ and $R^3$ hydrocarbon chains is from 14 to 24 carbon atoms, or mixtures thereof.

Examples of particularly suitable betaine surfactants include C12-C18 alkyl dimethyl betaine such as coconutbetaine and C10-C16 alkyl dimethyl betaine such as laurylbetaine. Coconutbetaine is commercially available from Seppic under the trade name of Amonyl 2659. Laurylbetaine is commercially available from Albright & Wilson under the trade name Empigen BB/L.

Other specific zwitterionic surfactants have the generic formulas: $R^1$—C(O)—N $(R^2)$—$(C(R^3)_2)_n$—$N(R_2)_2(+)$—$(C(R^3)_2)_n$—$SO_3(-)$ or $R^1$—C(O)—N $(R^2)$—$(C(R^3)_2)_n$—N $(R^2)_2(+)$—$(C(R^3)_2)_n$—COO(−) wherein each $R^1$ is a hydrocarbon, e.g. an alkyl group containing from 8 up to 20, or up to 18, or up to 16 carbon atoms, each $R^2$ is either a hydrogen (when attached to the amido nitrogen), short chain alkyl or substituted alkyl containing from one to 4 carbon atoms, or groups selected from the group consisting of methyl, ethyl, propyl, hydroxy substituted ethyl or propyl and mixtures thereof, or methyl, each $R^3$ is selected from the group consisting of hydrogen and hydroxy groups and each n is a number from 1 to 4, or from 2 to 3, or 3, with no more than one hydroxy group in any $(C(R^3)_2)$ moiety. The $R^1$ groups can be branched and/or unsaturated. The R2 groups can also be connected to form ring structures. A surfactant of this type is a C10-C14 fatty acylamidopropylene (hydroxypropylene) sulfobetaine that is available from the Sherex Company under the trade name "Varion CAS sulfobetaine".

A suitable composition contains a binary surfactant thickener comprising a betaine and anionic counterion. Examples of other suitable surfactants include amine oxides, sarcosinates, taurates and quaternary ammonium compounds.

Operative betaines include the $C_{14-18}$ alkyl betaines and $C_{14-18}$ alkyl sulfobetaines. Suitable is a cetyl dimethyl betaine (CEDB) such as Amphosol CDB (a trademarked product of the Stepan Company), which is about 95% or greater $C_{16}$, less than 5% $C_{12/14}$ and less than 1% $C_{18}$. It is noted that when referring to carbon chain lengths of the betaine or any other compound herein, the commercial, polydisperse forms are contemplated (but not, required). Thus, a given chain length within the $C_{14-18}$ range will be predominately, but not exclusively, the specified length. As used herein in reference to the betaine or sulfobetaine, the term "alkyl" includes both saturated and unsaturated groups. Fully saturated alkyl groups are suitable in the presence of hypochlorite. $C_{10-18}$ alkylamido and alkylamino betaines, and sulfobetaines having $C_{14-18}$ alkyl, or $C_{10-18}$ alkylamino or alkylamido groups, are also suitable for use in the compositions of the present invention.

The betaine is added at levels, which, when combined with the counterion, are thickening effective. Generally about 0.1 to 10.0 weight percent of the betaine is utilized, or about 0.1 to 5.0% betaine, or about 0.15-2.0% betaine.

The counterion is an anionic organic counterion selected from the group consisting of $C_{2-6}$ alkyl carboxylates, aryl carboxylates, $C_{2-10}$ alkyl sulfonates, aryl sulfonates, sulfated $C_{2-10}$ alkyl alcohols, sulfated aryl alcohols, and mixtures thereof. The aryl compounds are derived from benzene or napthalene and may be substituted or not. The alkyls may be branched or straight chain, or are those having two to eight carbon atoms. The counterions may be added in acid form and converted to the anionic form in situ, or may be added in anionic form. Suitable substituents for the alkyls or aryls are $C_{1-4}$ alkyl or alkoxy groups, halogens, nitro groups, and mixtures thereof. Substituents such as hydroxy or amine groups are suitable for use with some non-hypochlorite cleaning actives, such as solvents, surfactants and enzymes. If present, a substituent may be in any position on the rings. If benzene is used, the para (4) and meta (3) positions are preferred. In some circumstances the cleaning active itself may be within the class of thickening-effective counterions. For example, some carboxylic acid cleaning actives may be present in both the acid and conjugate base forms, the latter which could serve as the counterion. The $C_{2-6}$ alkyl carboxylates may act in this manner. The counterion is added in an amount sufficient to thicken and result in a viscoelastic rheology, suitably between about 0.01 to 10 weight percent. A suitable mole ratio of betaine to counterion depends on the chain length and concentration of the betaine, type of counterion, and the ionic strength of the solution, as well as whether the primary object of the composition is phase stability or viscosity. Using CEDB and sodium xylene sulfonate (SXS), a suitable mole ratio is about 10:1 to 1:3, or about 2:1 to 1:2. A suitable weight ratio of CEDB to SXS is about 15:1 to 1:2, or3:1 to 1:1.

Oxidants

Oxidants, when used, include, but are not limited to, peracids, hypohalite sources, hydrogen peroxide, and/or sources of hydrogen peroxide. An oxidant source may be selected from various hypochlorite-producing species, for example, halogen oxidants selected from the group consisting of the alkali metal and alkaline earth salts of hypohalite, haloamines, haloimines, haloimides and haloamides. All of these are believed to produce hypohalous oxidant species in situ. Hypochlorite and compounds producing hypochlorite in aqueous solution are suitable and hypobromite is also suitable. Representative hypochlorite-producing compounds include sodium, potassium, lithium and calcium hypochlorite, chlorinated trisodium phosphate dodecahydrate, potassium and sodium dicholoroisocyanurate and trichlorocyanuric acid. Organic oxidant sources suitable for use include heterocyclic N-bromo and N-chloro imides such as trichlorocyanuric and tribromo-cyanuric acid, dibromo- and dichlorocyanuric acid, and potassium and sodium salts thereof, N-brominated and N-chlorinated succinimide, malonimide, phthalimide and naphthalimide. Also suitable are hydantoins, such as dibromo and dichloro dimethyl-hydantoin, chlorobromodimethyl hydantoin, N-chlorosulfamide (haloamide) and chloramine (haloamine). Suitable in this invention is sodium hypochlorite having the chemical formula NaOCl, in an amount ranging from about 0.1 weight percent to about 15 weight percent, or about 0.2% to 10%, or about 2.0% to 6.0%. It may be necessary to add a buffer or other alkaline agent to increase the composition pH to above about 10.0, or about 12.0 to maintain the storage stability of the composition.

According to the present invention, the oxidizing agent may be an oxygen bleach, including a peroxygen, peroxyhydrate or active oxygen generating compound. Suitable peroxygen bleaches for use herein include hydrogen peroxide or sources thereof. As used herein a source of hydrogen peroxide refers to any compound which generates active oxygen when said compound is in contact with water. Suitable water-soluble sources of hydrogen peroxide for use herein include percarbonates, preformed percarboxylic acids, persilicates, persulphates, perborates, organic and inorganic peroxides and/or hydroperoxides.

In one embodiment, hydrogen peroxide is employed in the aqueous composition of the present invention. The compositions of the present invention that comprise a peroxygen bleach may further comprise a bleach activator or mixtures thereof. By "bleach activator", it is meant herein a compound which reacts with peroxygen bleach like hydrogen peroxide to form a peracid. The peracid thus formed constitutes the activated bleach. Suitable bleach activators to be used herein include those belonging to the class of esters, amides, imides, or anhydrides. Examples of suitable compounds of this type are disclosed in British Patent GB 1 586 769 and GB 2 143 231 and a method for their formation into a prilled form is described in European Published Patent Application EP-A-62 523. Suitable examples of such compounds to be used herein are tetracetyl ethylene diamine (TAED), sodium 3,5,5 trimethyl hexanoyloxybenzene sulphonate, diperoxy dodecanoic acid as described for instance in U.S. Pat. No. 4,818,425 and nonylamide of peroxyadipic acid as described for instance in U.S. Pat. No. 4,259,201 and n-nonanoyloxybenzenesulphonate (NOBS). Also suitable are N-acyl caprolactams selected from the group consisting of substituted or unsubstituted benzoyl caprolactam, octanoyl caprolactam, nonanoyl caprolactam, hexanoyl caprolactam, decanoyl caprolactam, undecenoyl caprolactam, formyl caprolactam, acetyl caprolactam, propanoyl caprolactam, butanoyl caprolactam pentanoyl caprolactam or mixtures thereof. A particular family of bleach activators of interest was disclosed in EP 624 154, and particularly preferred in that family is acetyl triethyl citrate (ATC). Acetyl triethyl citrate has the advantage that it is environmental-friendly as it eventually degrades into citric acid and alcohol. Furthermore, acetyl triethyl citrate has a good hydrolytical stability in the product upon storage and it is an efficient bleach activator. A particular family of bleach activators also of interest was disclosed in U.S. Pat. No.s 5,741,437, 6,010,994 and 6,046,150, generally described as n-alkyl alkyl ammonium acetonitrile activators, and particularly preferred in that family is n-methyl morpholinium acetonitrile (MA).

In addition, other classes of peroxides can be used as an alternative to hydrogen peroxide and sources thereof or in combination with hydrogen peroxide and sources thereof. Suitable classes include dialkylperoxides, diacylperoxide, performed percarboxylic acids, organic and inorganic peroxides and/or hydroperoxides. Suitable organic peroxides/hydroperoxides include diacyl and dialkyl peroxides/hydroeroxides such as dibenzoyl peroxide, t-butyl hydroperoxide, dilauroyl peroxide, dicumyl peroxide, and mixtures thereof. Suitable preformed peroxyacids for use in the compositions according to the present invention include diperoxydodecandioic acid DPDA, magnesium perphthalic acid, perlauric acid, perbenzoic acid, diperoxyazelaic acid and mixtures thereof.

Persulfate salts, or mixtures thereof, are alternative sources of active oxygen that may be used in the compositions according to the present invention. In one embodiment, a persulfate salt can be used herein in the form of the monopersulfate triple salt. One example of monopersulfate salt commercially available is potassium monopersulfate commercialized by Peroxide Chemie GMBH under the trade name Curox®, by Degussa under the trade name Caroat and from Du Pont under the trade name Oxone. Other persulfate salts such as dipersulfate salts commercially available from Peroxide Chemie GMBH can be used in the compositions according to the present invention.

In embodiments employing a solid oxidizing agent and/or solid bleaching component, the material is preferably employed in the form of a finely divided particulate having a particle size, and/or average particle size distribution, that is sufficiently small to enable suspension in the aqueous composition with a minimum of settling or precipitation. In an alternative embodiment employing a particulate source of oxidizing agent, the agent is coated and/or encapsulated according to any known methods and materials in the art to prevent and/or retard dissolution of the agent in the aqueous compositions during storage, such encapsulation means and materials selected, however, so as to provide release of the oxidizing agent upon dilution of the compositions into a larger volume of water, such as for example, during dilution into a washing machine during use. In embodiments employing a plurality of oxidizing agents, or combinations of oxidizing agents, secondary oxidizing agents and/or oxidizing agents and/or activators, the materials may be present as separately dispersed particulate components, optionally coated and/or encapsulated, or alternatively present in the form of coated and/or encapsulated core agglomerate of the various agents, such coating or encapsulating material acting to prevent or retard water penetration into the core agglomerate under storage conditions, but providing release as described hereinbefore.

In a further embodiment, both a source of water soluble oxidizing agent and a particulate oxidizing agent are combined so as to provide a composition according to the present invention having immediate bleaching strength combined with a reserve bleaching strength when the compositions are diluted for use.

In yet further embodiments, only a low water solubility oxidizing agent, or alternatively a coated and/or encapsulated oxidizing agent, are employed in the inventive compositions so as to provide minimal or no bleaching effect, for example providing a composition that will not damage or over bleach a susceptible fabric or dye even upon (improper) direct application, such compositions however being capable of releasing the oxidizing agent when the composition is properly diluted for use, such as in a washing machine, where the diluted level of the oxidizing agent will not damage the fabric or dye.

Optional ingredients

The pH of the liquid compositions according to the present invention, as is, is typically from 4 to 14, or from 10 to 14, or from 12 to 14. The liquid compositions of the invention have a pH of from 7.5 to 13, or from 8 to 12, or from 8.5 to 11.5, when diluted into 1 to 500 times its weight of water. The pH range is suitably provided by the hypohalite bleach, which are alkalis and optionally by the pH buffering component if present. However, in addition to these components, a strong source of alkalinity may also optionally be used.

Suitable sources of alkalinity are the caustic alkalis such as sodium hydroxide, potassium hydroxide and/or lithium hydroxide, and/or the alkali metal oxides such as sodium and/or potassium oxide. A suitable strong source of alkalinity is a caustic alkali, for example sodium hydroxide and/or potassium hydroxide. Typical levels of such caustic alkalis, when present, are of from 0.1% to 1.5% by weight, or from 0.5% to 1.5% by weight of the composition.

The composition according to the invention may comprise other optional components such as pH buffering components, stabilizing agents, other oxidant-stable surfactants, builders, thickening agents, polymers, dyes, solvents, perfumes, brighteners, and mixtures thereof.

The compositions according to the present invention may optionally comprise a pH buffering component or mixture thereof. The pH buffering component ensures that the pH of the composition is buffered to a pH value ranging from 7.5 to 13, or from 8 to 12, or from 8.5 to 11.5 after the composition has been diluted into 1 to 500 times its weight of water. Suitable pH buffering components for use herein are selected from the group consisting of alkali metal salts of carbonates, polycarbonates, sesquicarbonates, silicates, polysilicates, boron salts, phosphates, stannates, alluminates and mixtures thereof. Suitable alkali metal salts for use herein are sodium and potassium.

Suitable boron salts or mixtures thereof for use herein include alkali metal salts of borates and alkyl borates and mixtures thereof. Examples of boron salts include boric acid, alkali metal salts of metaborate, tetraborate, octoborate, pentaborate, dodecaboron, borontrifluoride and alkyl borate containing from 1 to 12 carbon atoms, or from 1 to 4. Suitable alkyl borate includes methyl borate, ethyl borate and propyl borate. Suitable boron salts herein are the alkali metal salts of metaborate, such as sodium metaborate, potassium metaborate, and the alkali metal salts of borate, such as sodium borate, or mixtures thereof. Boron salts like sodium metaborate and sodium tetraborate are commercially available from Borax and Societa Chimica Larderello under the names sodium metaborate and Borax.

Suitable pH buffering components are selected from the group consisting of sodium carbonate, sodium silicate, sodium borate, sodium metaborate and mixtures thereof. The raw materials involved in the preparation of hypohalite bleaches usually contain by-products, e.g. calcium carbonate resulting in an amount of up to 0.4% by weight of by-product within the hypohalite composition. However, at such amount, the by-product will not have the buffering action defined above. Liquid oxidant compositions herein preferably contain an amount of pH buffering component of from 0.5% to 9% by weight, or from 0.5% to 5% by weight, or from 0.6% to 3% by weight of the composition.

Suitable radical scavengers for use herein include aromatic radical scavengers comprising an unsaturated ring system of from 3 to 20 carbon atoms, or from 3 to 18, or from 5 to 14 and having a double bond set comprising a total of 4n+2 electrons, wherein n is an integer of from 0 to 4, preferably of from 1 to 3. Indeed said aromatic radical scavengers include benzene derivatives, naphthalene derivatives, annulene derivatives, cyclopentadiene derivatives, cyclopropene derivatives and the like, especially aryl carboxylates and/or aryl sulfonates.

Viscosity of the compositions herein may be enhanced by including aliphatic and aromatic hydrocarbon oils such as hexadecane and dodecylbenzene.

The composition of the present invention can be formulated to include such components as fragrances, coloring agents, whiteners, solvents, soil release polymers, bacteriocidal agents, chelating agents and builders, which enhance performance, stability or aesthetic appeal of the composition. The composition of the present invention may contain from about 0.01% to about 0.5% of a fragrance such as those commercially available from International Flavors and Fragrance, Inc. Dyes and pigments may be included in small amounts. Ultramarine Blue (UMB) and copper phthalocyanines are examples of widely used pigments which may be incorporated in the composition of the present invention.

Water

It should be briefly noted that the main ingredient of the oxidizing compositions disclosed herein is water, preferably softened, distilled or deionized water. Water provides the continuous liquid phase into which the other ingredients are added to be dissolved/dispersed. The amount of water present generally exceeds 30% and can be as high as 99.9%, although generally, it is present in a quantity sufficient (q.s.) to provide the appropriate rheology characteristics desired.

Surfaces

In the present invention, the composition can be used to treat surfaces. By "surfaces", it is meant herein any inanimate surface. These inanimate surfaces include, but are not limited to, hard-surfaces typically found in houses like kitchens, bathrooms, or in car interiors, e.g., tiles, walls, floors, chrome, glass, smooth vinyl, any plastic, plastified wood, table top, sinks, cooker tops, dishes, sanitary fittings such as sinks, showers, shower curtains, wash basins, toilets and the like, as well as fabrics including clothes, curtains, drapes, bed linens, bath linens, table cloths, sleeping bags, tents, upholstered furniture and the like, and carpets. Inanimate surfaces also include household appliances including, but not limited to, refrigerators, freezers, washing machines, automatic dryers, ovens, microwave ovens, dishwashers and so on.

Thus, the present invention also encompasses a process of treating (e.g. bleaching) a fabric, as the inanimate surface. In such a process a fabric is contacted with a composition according to the present invention. In another embodiment the present invention also encompasses a process of treating a hard surface, as the inanimate surface. In such a process a composition, as defined herein, is contacted with the hard surfaces to be treated. Thus, the present invention also encompasses a process of treating a hard-surface with a composition, as defined herein, wherein said process comprises the step of applying said composition to said hard surface, preferably only soiled portions thereof, and optionally rinsing said hard surface.

In the process of treating surfaces according to the present invention the composition, as defined herein, may be applied to the surface to be treated in its neat form or in its diluted form typically up to 200 times their weight of water, or 80 to 2 times their weight of water, or 60 to 2 times.

Container

One example of containers suitable for use in the invention are those for manually cleaning the toilet bowl by delivering a cleaning fluid through a nozzle that is inclined to facilitate directing a fluid to surfaces within the toilet bowl, such as the sides. Other suitable containers can deliver the composition to a vertical hard surface. Such containers include one or more apertures through which the fluid is delivered as the flexible sides of the container are squeezed. Examples of suitable containers are described in U.S. Pat. No. 6,691,328 to Delfino, U.S. Pat. No. 6,583,103 to Klinkhamer, and U.S. Pat. No. 5,261,567 to Krall. U.S. Pat. No. 6,425,406 to Klinkhammer et al. describes a variety of toilet cleaning devices and methods. U.S. Pat. No. 6,234,412 to von Schuckmann describes suitable spray devices.

The invention may also include a system including the composition contained within a suitable container and instructions to apply the composition, for example to the sides of a toilet bowl or a vertical hard surface.

EXAMPLES

Inventive compositions were prepared as shown in Table I and tested with consumers against commercial manual toilet bowl cleaners in Table II. The rheology of the inventive compositions and comparative commercial compositions are given in Table III.

TABLE I

| Components | Composition A (% Actives) | Composition B (% Actives) |
|---|---|---|
| NaOH | 0.70 | 0.70 |
| Coconut Fatty Acid[a] | 1.08 | 0.95 |
| Myristyldimethylamineoxide[b] | 0.80 | 0.62 |
| Lauryldimethylamineoxide[c] | 0.50 | 0.50 |
| Potassium Iodide | 0.004 | 0.004 |
| Sodium hypochlorite | 3.00 | 3.00 |
| Pigment | 0.002 | 0.002 |
| Fragrance | 0.12 | 0.12 |
| Balance Water | | |

[a]Emery Coco Fatty Acid ®
[b]Ammonyx MO ®
[c]Ammonyx LO ®

TABLE II

| Consumer attributes | Lysol ® Bleach Manual Toilet Bowl Cleaner | Composition A | Composition B |
|---|---|---|---|
| Overall rating | Basis | Preferred | Preferred |
| Cling | Basis | Equal | Preferred |
| Easy to dispense | Basis | Preferred | Preferred |

TABLE III

| Sample | Zero-shear viscosity (cP) | Relaxation constant (s)* | Gel parameter** |
|---|---|---|---|
| Oxidant compositions | | | |
| Composition A | 510 | 0.079 | 0.97 |
| Composition B | 220 | 0.062 | 0.96 |
| Clorox ® Bleach MTBC | 830 | 0.256 | 1.06 |
| Lysol ® Bleach MTBC | 1170 | 0.163 | 1.34 |
| Clorox ® Cleanup Gel | 290 | 0.128 | 0.97 |
| Professional Strength Liquid Plum'r ® | 5050 | 13.3 | 1.23 |
| Non-oxidant compositions | | | |
| Clorox ® MTBC | 360 | 0.209 | 1.11 |
| Lysol Cling ® MTBC | 750 | 0.188 | 1.16 |
| Lime-a-way ® | 104 | 0.103 | 0.96 |
| Easy-Off BAM ® | 418 | 0.293 | 1.03 |

*Relaxation constant is the inverse of frequency in Hz at cross-over of G', G''

**Gel parameter is the ratio of steady-state shear viscosity at a shear rate of $2\pi/(100 * RC)$ to Zero-shear viscosity (from frequency sweep)

Without departing from the spirit and scope of this invention, one of ordinary skill can make various changes and modifications to the invention to adapt it to various usages and conditions. As such, these changes and modifications are properly, equitably, and intended to be, within the full range of equivalence of the following claims.

We claim:

1. A cleaning system comprising:

a. a composition comprising:

i. greater than 0.5% oxidant;

ii. at least two amine oxides;

iii. a $C_6$-$C_{18}$ fatty acid;

iv. a pigment;

v. wherein the composition has a Zero-shear viscosity greater than 300 cP; and vi. wherein the composition has a Relaxation constant of less than 0.1 second;

b. a container having the composition within; and c. instructions to apply the composition to the side of a toilet bowl.

2. The cleaning system of claim 1, wherein the oxidant is sodium hypochlorite.

3. A cleaning system comprising:

a. a composition comprising:

i. greater than 0.5% oxidant;

ii. at least two amine oxides;

iii. a $C_6$-$C_{18}$ fatty acid;

iv. a pigment;

v. wherein the composition has a Zero-shear viscosity greater than 300 cP; and vi. wherein the composition has a Relaxation constant of less than 0.1 second;

b. a container having the composition within; and c. instructions to spray the composition on a vertical hard surface.

4. The cleaning system of claim 3, wherein the oxidant is sodium hypochlorite.

5. A cleaning composition comprising:

a. an oxidant;

b. at least two amine oxides;

c. a $C_6$-$C_{18}$ fatty acid;

d. a pigment;

e. wherein the composition has a Zero-shear viscosity greater than 300 cP; and f. wherein the composition has a Relaxation constant of less than 0.1 second.

6. The composition of claim 5, wherein the oxidant is selected from the group consisting of hypohalite, hypohalite generating compounds, and mixtures thereof.

7. The composition of claim 6, wherein the oxidant is sodium hypochlorite.

8. The composition of claim 5, wherein the oxidant is selected from the group consisting of peracids, peroxides, peroxide sources, and mixtures thereof.

9. The composition of claim 5, wherein the Zero-shear viscosity is greater than 400 cP.

10. The composition of claim 5, wherein the Zero-shear viscosity is greater than 500 cP.

11. The composition of claim 5, wherein the composition is dispensed from a container designed to clean toilet bowls.

12. The composition of claim 5, wherein the composition is dispensed from a spray bottle.

13. The composition of claim 1, wherein the at least two amine oxides comprise at least lauryldimethylamineoxide and myristyldimethylamineoxide.

14. The composition of claim 3, wherein the at least two amine oxides comprise at least lauryldimethylamineoxide and myristyldimethylamineoxide.

15. The composition of claim 5, wherein the at least two amine oxides comprise at least lauryldimethylamineoxide and myristyldimethylamineoxide.

16. The composition of claim 1, wherein the fatty acid is 0.5-1.5% by weight.

17. The composition of claim 3, wherein the fatty acid is 0.5-1.5% by weight.

18. The composition of claim 5, wherein the fatty acid is 0.5-1.5% by weight.

19. The composition of claim 1, wherein the fatty acid is a coconut fatty acid.

20. The composition of claim 3, wherein the fatty acid is a coconut fatty acid.

21. The composition of claim 5, wherein the fatty acid is a coconut fatty acid.

* * * * *